US006268787B1

(12) United States Patent
Onizuka

(10) Patent No.: US 6,268,787 B1
(45) Date of Patent: Jul. 31, 2001

(54) FERRITE-CORE HOUSING CASE ANTI-NOISE COMPONENT WIRE HARNESS AND ELECTRONIC EQUIPMENT

(75) Inventor: Masahiro Onizuka, Tokyo (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 09/453,517

(22) Filed: Dec. 3, 1999

(30) Foreign Application Priority Data

Dec. 4, 1998 (JP) ..... 10-361960

(51) Int. Cl.[7] ..... H01F 27/02; H01F 17/06

(52) U.S. Cl. ..... 336/92; 336/90; 336/174; 336/175; 336/176

(58) Field of Search ..... 336/90, 92, 175, 336/176, 174

(56) References Cited

U.S. PATENT DOCUMENTS 5,095,296 3/1992 Parker .
5,920,250 * 7/1999 Watanabe et al. ..... 336/92

FOREIGN PATENT DOCUMENTS 1-73905 5/1989 (JP) .
2-49194 4/1990 (JP) .
2-120898 9/1990 (JP) .
5-90779 4/1993 (JP) .

OTHER PUBLICATIONS

U.S. application No. 09/261,228, filed Mar. 3, 1999.
U.S. application No. 09/453,517, filed Dec. 3, 1999.
U.S. application No. 09/454,528, filed Dec. 6, 1999.

* cited by examiner

*Primary Examiner*—Karl D. Easthom
*Assistant Examiner*—Anh Mai
(74) *Attorney, Agent, or Firm*—Oblon, Spivak, McClelland, Maier & Neustadt, P.C.

(57) ABSTRACT

A ferrite-core housing case 20 has a first split case half 21, and a second split case half 22 that is openable with respect to the first split case half 22, and houses a ferrite core 1 for a flat cable. A pair of spring portions 27 which press the ferrite core 1 are formed in at least one of the first and second split case halves 21 and 22, and a fulcrum of each of the spring portions 27 is located on a side face 22*b* of the split case half while an acting point is located on a center side.

10 Claims, 10 Drawing Sheets

FERRITE-CORE HOUSING CASE ANTI-NOISE COMPONENT WIRE HARNESS AND ELECTRONIC EQUIPMENT

BACKGROUND OF THE INVENTION

1. Field of the Invention

The present invention relates to a ferrite-core housing case for housing a ferrite core which is to be attached to a flat cable to suppress noises propagating through the flat cable, an anti-noise component in which a ferrite core is housed in such a case, and a wire harness and an electronic apparatus to which such an anti-noise component is attached.

2. Discussion of the Background

Conventionally, an anti noise measure is taken by using a ferrite core in a cable connecting various electronic apparatuses. Such a cable includes a flat cable. Also in a cable of this kind, an anti noise measure is taken in the same manner.

As a ferrite core used for an anti noise measure in a flat cable, used is a flat O-like (flat ring-like) ferrite core 1 such as shown in FIG. 6 and having a slit-like hole 2 through which a flat cable FC is to be passed. Such a ferrite core 1 has the illustrated integral type structure or a split type one in which split core halves are butted against each other to form a flat O-like shape.

This ferrite core 1 is used while the flat cable FC is passed therethrough. When the cable is passed and no further measure is taken, the ferrite core is moved along the cable. When the ferrite core 1 is moved on the flat cable FC, there arises a fear that the ferrite core 1 collides with the interior of an apparatus in the vicinity of the place where the ferrite core 1 is attached, and the apparatus or the ferrite core 1 is damaged. Furthermore, a desired noise reduction effect may not be attained depending on the place of the flat cable FC.

These problems can be solved by fixing the ferrite core on the flat cable. This can be implemented by a method in which the ferrite core is fixed to the flat cable by means of an adhesive agent or an adhesive tape, or that in which the ferrite core is fixed to an apparatus housing or a circuit board which is in the vicinity of the core, by means of an adhesive agent or an adhesive tape.

However, these methods are low in working efficiency. As a countermeasure, a component 5 such as shown in FIG. 7 and for fixing positions of a ferrite core and a flat cable has been proposed (produced by TOKIN Corporation, product name: FPD-CL-1 camp). The component 5 is characterized in that it is attached to a side face of each of the end portions of a ferrite core 1 and can be fixed to an apparatus housing or a circuit board 10 by, for example, fastening of a bolt 7 and a nut 8 with using a hole 6 formed in the component 5.

In the case where the ferrite core 1 is to be attached to an apparatus housing or a circuit board by using the component 5 of FIG. 7, however, the component is attached to the ferrite core 1 and the fixing work must be then conducted while pressing the ferrite core 1 and the component 5 by a hand so as not to separate them from each other. When the ferrite core 1 is once fixed onto the circuit board and the core is to be then detached therefrom, the ferrite core 1 can be detached from the circuit board, only after the whole of the assembly is detached therefrom.

In order to solve these problems, the assignee of the present application has proposed an anti-noise component for a flat cable in U.S. patent application Ser. No. 09/261,228. The proposed anti-noise component is characterized in that a split type ferrite core 1 (configured by butting split ferrite core halves 1*a* and 1*b* against each other) which is to be attached to a flat cable FC is housed in an openable and closeable case 15 (configured by coupling split case halves 15*a* and 15*b* to each other), and a coupling portion 18 for fixation to a circuit board is formed on a bottom portion of the case, whereby attachment and detachment of the ferrite core 1 is facilitated, and the ferrite core 1 is prevented from being damaged with a shock, and easily attached to an apparatus, a circuit board, etc.

In the anti-noise component shown in FIG. 8, the ferrite core 1 is pressed by a spring portion 16 formed in a center portion of the upper face of the split case half 15*b* in order to, when the case 15 is closed, prevent the ferrite core 1 housed therein from being moved in the case. When the ferrite core 1 is moved in the case 15, the ferrite core 1 bumps against the case 5 to produces acoustic noises. This is not preferable.

In the component disclosed in U.S. patent application Ser. No. 09/261,228, as shown in FIG. 8, the spring portion 16 is disposed in the center portion of the upper face of the split case half. Because the split case halves 15*a* and 15*b* have a flexibility of a certain degree, the disposition of the spring portion at such a position causes the force of the spring portion 16 pressing the ferrite core 1 to be applied also to the case 15, thereby raising the split case half 15*b*. This raised state is shown in FIG. 9. When the ferrite core 1 is housed, the upper face of the split case half 15*b* which is originally in the state indicated by the solid line is raised in the center portion of the case half to warp the case 15. When the case 15 is warped, the force of the spring portion 16 pressing the ferrite core 1 is reduced, so that the ferrite core 1 cannot be sufficiently fixed. The warped state of the case 15 impairs the appearance of the case.

Also in the case where two spring portions 17 are disposed in a center portion of the upper face of the split case half 15*b* as shown in FIG. 10, there arises a phenomenon in which, when the ferrite core 1 is housed, the center portion of the case half is raised as indicated by the broken lines to warp the case 15.

The force of the spring portion is enhanced by increasing the inclination angle of the spring portion with respect to the inner face of the case. In accordance with enhancement of the force, also the force of raising the split case half is increased so as to further warp the case.

SUMMARY OF THE INVENTION

It is a first object of the invention to provide a ferrite-core housing case which has been proposed by the assignee of the present application, and in which warpage of the case housing a ferrite core that is prevented from occurring, the ferrite core can be pressed so as to be surely held, and fixation and detachment of the ferrite core with respect to a flat cable can be easily implemented, and also an anti-noise component in which a ferrite core is housed in such a case.

It is a second object of the invention to provide a wire harness and an electronic apparatus which have an anti-noise component that can be easily attached to and detached from a flat cable and that can surely hold an incorporated ferrite core.

In order to attain the objects, the ferrite-core housing case of the present invention comprises a first split case half, and a second split case half that is openable with respect to the first split case half, a ferrite core to be housed in the case, through which an electronic cable passes, a pair of spring portions which press the ferrite core are formed in at least one of the first and second split case halves, and a fulcrum of each of the spring portions is located on a side face of the split case half while an acting point is located on a center side.

According to the invention, the fulcrum of a spring portion which is disposed in a split case half is located on a side face of the split case half or in the vicinity of the side face, thereby preventing the split case half from being pushed upward to be warped.

When the anti-noise component for a flat cable is to be attached to a flat cable, the component has a flat shape in the same manner as the shape of the flat cable. The side faces of the split case half are coupled to each other. When the fulcrum of a spring portion is located in the vicinity of the center of the upper face of the split case half, therefore, a force is applied to the upper face of the split case half, so that, if the split case half is highly flexible, a center portion of the upper face of the split case half is raised to be warped. By contrast, when the fulcrum of a spring portion is located on a side face of the split case half or in the vicinity of the side face, a force is applied to the coupled side faces. Even when a force of raising the split case half is applied, therefore, the case half is hardly raised because the case half is fixed at the coupling portion. As compared with the case where the fulcrum is in the vicinity of a center portion, warpage of the split case half is very smaller in degree. Since the split case half is prevented from being raised, most of the force of the spring portion is applied to the ferrite core, and hence the ferrite core can be effectively fixed.

The anti-noise component of the invention comprises: a ferrite core having a slit-like hole through which a flat cable is to be passed; and an openable and closeable case which covers the ferrite core while the slit-like hole is exposed through the case, the case has a first split case half, and a second split case half that is openable with respect to the first split case half, a pair of spring portions which press the ferrite core are formed in at least one of the first and second split case halves, and a fulcrum of each of the spring portions is located on a side face of the split case half while an acting point is located on a center side.

According to the invention, it is possible to obtain an anti-noise component for a flat cable in which a ferrite core is housed in the ferrite-core housing case as mentioned above. Even when the anti-noise component is attached to a ferrite cable, therefore, the appearance is not impaired by warpage of the case. Furthermore, the ferrite core can be fixed with a sufficient force, and hence the ferrite core is not moved in the case by vibration, so that noises are prevented from occurring.

The wire harness of the invention comprises: a ferrite core having a slit-like hole; a flat cable which is passed through the slit-like hole; and an openable and closeable case which covers the ferrite core while the slit-like hole is exposed through the case, the case has a first split case half, and a second split case half that is openable with respect to the first split case half, a pair of spring portions which press the ferrite core are formed in at least one of the first and second split case halves, and a fulcrum of each of the spring portions is located on a side face of the split case half while an acting point is located on a center side.

According to the invention, a wire harness in which the anti-noise component as mentioned above is attached to a flat cable is configured. Therefore, the work of assembling the wire harness into an electronic apparatus can be efficiently performed, and a countermeasure against noises can be easily conducted on the electronic apparatus.

The electronic apparatus of the invention comprises an anti-noise component comprising: a ferrite core having a slit-like hole through which a flat cable is passed; and an openable and closeable case which covers the ferrite core while the slit-like hole is exposed through the case, the case has: a first split case half; and a second split case half that is openable with respect to the first split case half, a pair of spring portions which press the ferrite core are formed in at least one of the first and second split case halves, and a fulcrum of each of the spring portions is located on a side face of the split case half while an acting point is located on a center side.

According to the invention, in an electronic apparatus which uses the anti-noise component or the wire harness, a countermeasure against noises can be easily conducted on the electronic apparatus and the ferrite core can be fixed to the apparatus sufficiently and easily. Therefore, the working efficiency and the reliability can be improved.

BRIEF DESCRIPTION OF THE DRAWINGS

A more complete appreciation of the invention and many of the attendant advantages thereof will be readily obtained as the same becomes better understood by reference to the following detailed descriptions when considered in connection with the accompanying drawings, wherein.

DETAILED DESCRIPTION OF THE PREFERRED EMBODIMENTS

Hereinafter, embodiments of the ferrite-core housing case, the anti-noise component, the wire harness, and the electronic apparatus of the invention will be described with reference to the accompanying drawings.

Figure 1:
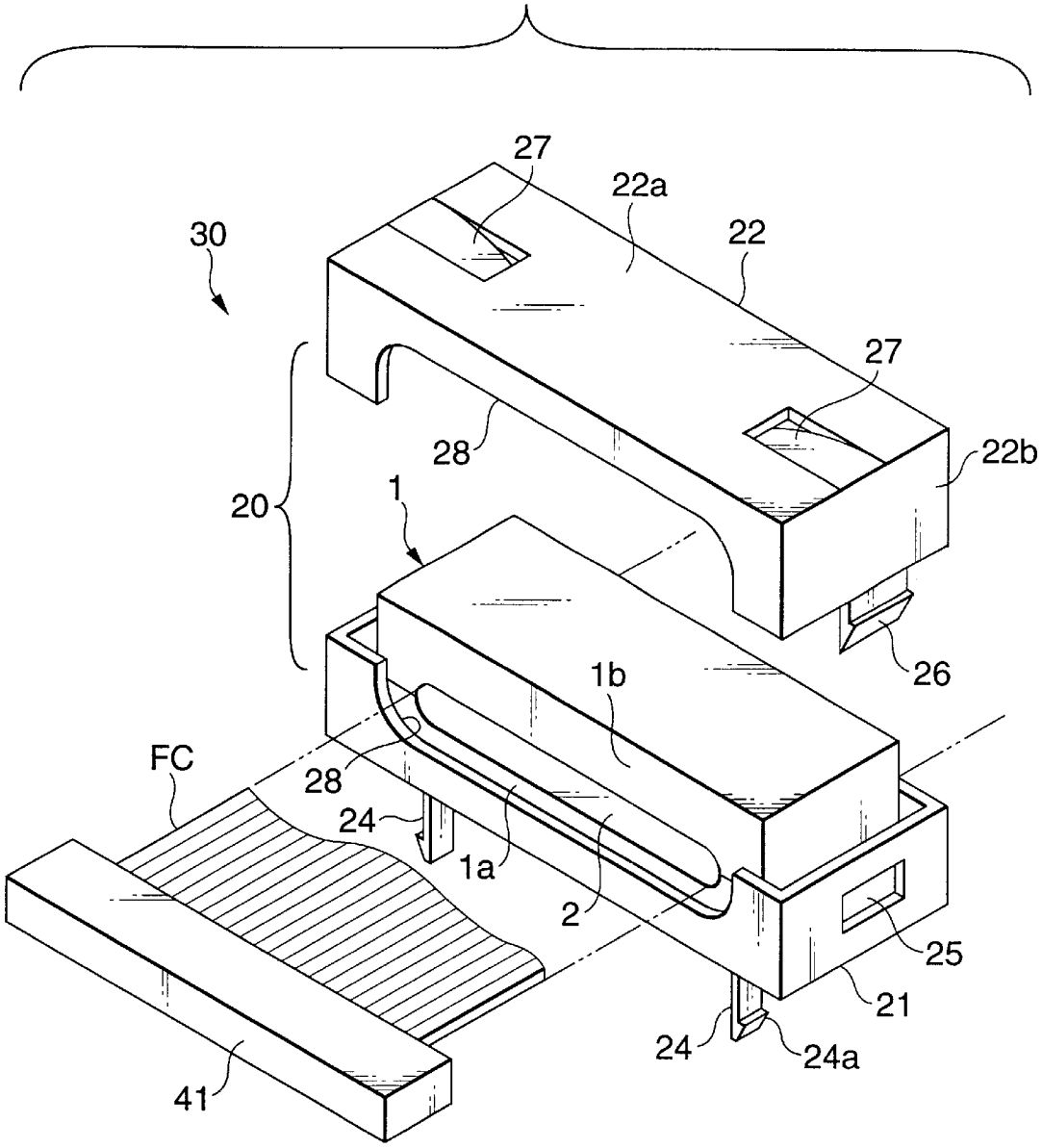
FIG. 1 is an exploded perspective view showing a first embodiment of the invention.
Figure 2:
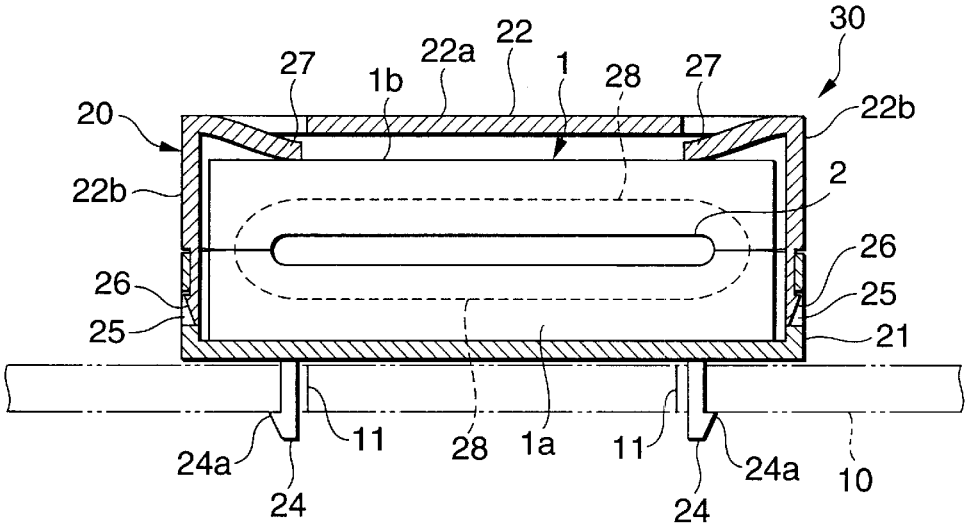
FIG. 2 is a front section view of the embodiment.

FIGS. 1 and 2 show a first embodiment of the invention. As shown in the figures, a ferrite-core housing case 20 is made of, for example, a metal or a resin (preferably, 66 Nylon) so as to cover a flat O-like (flat ring-like) ferrite core 1 having a slit-like hole 2 through which a flat cable FC is to be passed. The case consists of a first split case half (case body portion) 21, and a second split case half (case lid portion) 22 which is openable (detachable) with respect to the first split case half. Coupling portions 24 for fixation to an electronic apparatus are integrally formed on the bottom portion of the first split case half 21. As indicated by phantom lines in FIG. 2, for example, the fixation coupling portions 24 have a structure in which the fixation coupling portions 24 are respectively inserted into mounting holes (or grooves) 11 of a housing of the electronic apparatus or a circuit board 10 and then engaged therewith, so as to play a role of fixing the case half 21 to the apparatus housing or the circuit board.

The ferrite core 1 has a split type structure in which split ferrite core halves 1*a* and 1*b* are combined with each other.

In each pair of the end faces of the first and second split case halves 21 and 22, a pair of an engaging hole 25 and an engaging piece 26 with which the engaging hole can be engaged is formed as a coupling portion. When the case 20 is closed with butting the first and second split case halves 21 and 22 against each other, the engaging holes 25 and the engaging pieces 26 are respectively coupled (fitted) with each other, so as to maintain the case 20 in a closed state.

Spring portions (elastic pressing portions) 27 each having a fulcrum located on a side face 22*b* of the case half are integrally formed in the upper face 22*a* of the second split case half 22, in order to press the ferrite core 1 from the upper side by an elastic force.

The case 20 is configured so that, when the case is closed, the slit-like hole 2 of the ferrite core 1 is exposed. In other words, cut-away portions 28 are formed in each of the first and second split case halves 21 and 22, so as to form gaps that, when the case 20 is closed, produce a space through which the flat cable FC can be passed.

An anti-noise component 30 is configured so that the ferrite core 1 is housed in the ferrite-core housing case 20 and the ferrite core 1 is pressed and fixed by the spring portions 27.

A wire harness 40 has a structure wherein the flat cable FC to which a cable connector 41 or the like is attached is passed through the slit-like hole 2 of the ferrite core 1 of the anti-noise component 30.

As shown in FIG. 2, the wire harness 40 having the anti-noise component is fixed by inserting the fixation coupling portion 24 into a mounting hole (or groove) 11 of the housing of the electronic apparatus or the circuit board 10, thereby obtaining an electronic apparatus provided with the wire harness 40 having the anti-noise component.

The anti-noise component 30 can be attached to the flat cable FC in the following manner. The split ferrite core halves 1*a* and 1*b* are combined with each other, and the flat cable FC is then passed through the slit-like hole 2 of the ferrite core 1. Thereafter, the ferrite core 1 is housed in the first split case half 21 of the case 20 in the opened state. The second split case half 22 is then fitted to the first split case half 21 so as to close the case 20. When the fixation coupling portions 24 of the first split case half 21 are respectively inserted into the mounting holes (or grooves) 11 of the housing of the electronic apparatus or the circuit board 10 as indicated by the phantom lines in FIG. 2, elastic pawls 24*a* of the fixation coupling portions 24 are inserted into the holes and then engaged with the back side of the housing or the circuit board 10, whereby the case 20 can be fixed onto the apparatus housing or the circuit board. According to this configuration, the anti-noise component 30 can be attached to the flat cable FC, and positional relationships between the component and the cable FC can be maintained constant. Particularly, the component can be fixed to the apparatus housing or the circuit board with excellent workability. Even when vibration or a shock is applied to the apparatus, therefore, the anti-noise component 30 is not moved.

When the ferrite core 1 is to be taken out from the anti-noise component 30, the core can be easily taken out by opening the closed case 20 (by detaching the second split case half 22 from the first split case half 21 ). Also when the anti-noise component 30 attached to the apparatus housing or the circuit board is to be detached therefrom, the component can be easily detached by disengaging the pawls 24*a* of the fixation coupling portions 24 which are integrated with the case 20, from the apparatus housing or the circuit board. This can be conducted with very excellent workability, and there is no fear that a signal line in the cable is broken during the work.

Figure 9:
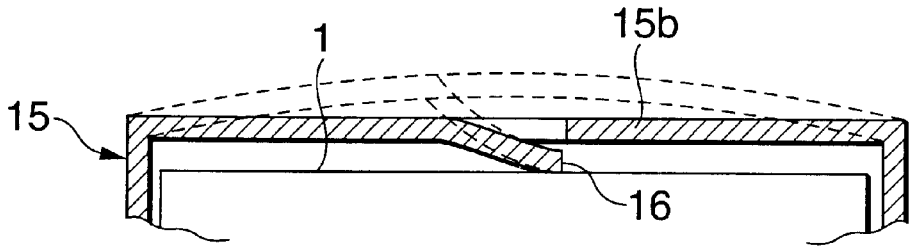
FIG. 9 is a partial section view showing a comparative example.
Figure 10:
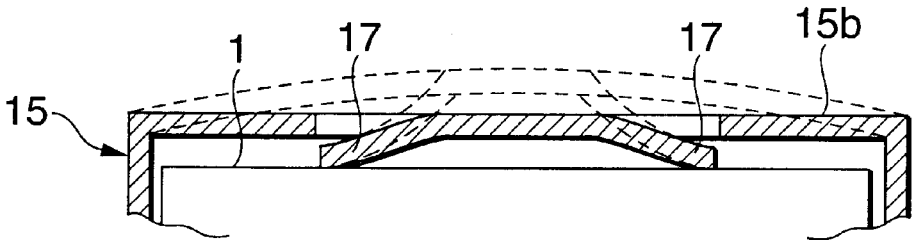
FIG. 10 is a partial section view showing another comparative example.

According to the first embodiment, in the ferrite-core housing case 20, the fulcrum of each of the spring portions 27 formed in the second split case half 22 is located on the corresponding side face 22*b* of the case half. When the ferrite core 1 is pressed by the spring portion 27, therefore, a force due to reaction is applied to the second split case half 22. However, the upper face 22*a* is not warped because the side face 22*b* coupled with the first split case half 21 functions as the fulcrum of the spring portion 27. By contrast, in the case where the fulcrum of the spring portion 16 or 17 is located in a center portion of the upper face of the split case half 15*b* as in the comparative examples of FIGS. 9 and 10, the upper face is pushed upward to be warped as indicated by phantom lines. In the case where the split case half is made of a material of high elasticity such as a resin, particularly, this phenomenon conspicuously appears. When the split case half is warped in this way, the force which is applied to the ferrite core 1 by the spring portion is reduced. This is not preferable.

Consequently, the first embodiment shown in FIGS. 1 and 2 can provide a ferrite-core housing case 20 in which warpage of the case 20 that houses the ferrite core 1 is prevented from occurring, the ferrite core 1 can be pressed to be surely held so that noises due to rattling of the ferrite core are prevented from being produced, and fixation and detachment of the ferrite core 1 with respect to the flat cable FC can be easily implemented, and also the anti-noise component 30 in which a ferrite core is housed in the case. Furthermore, it is possible to realize a wire harness and an electronic apparatus which have an anti-noise component that can be easily attached to and detached from a flat cable and that can surely hold an incorporated ferrite core.

Figure 3:
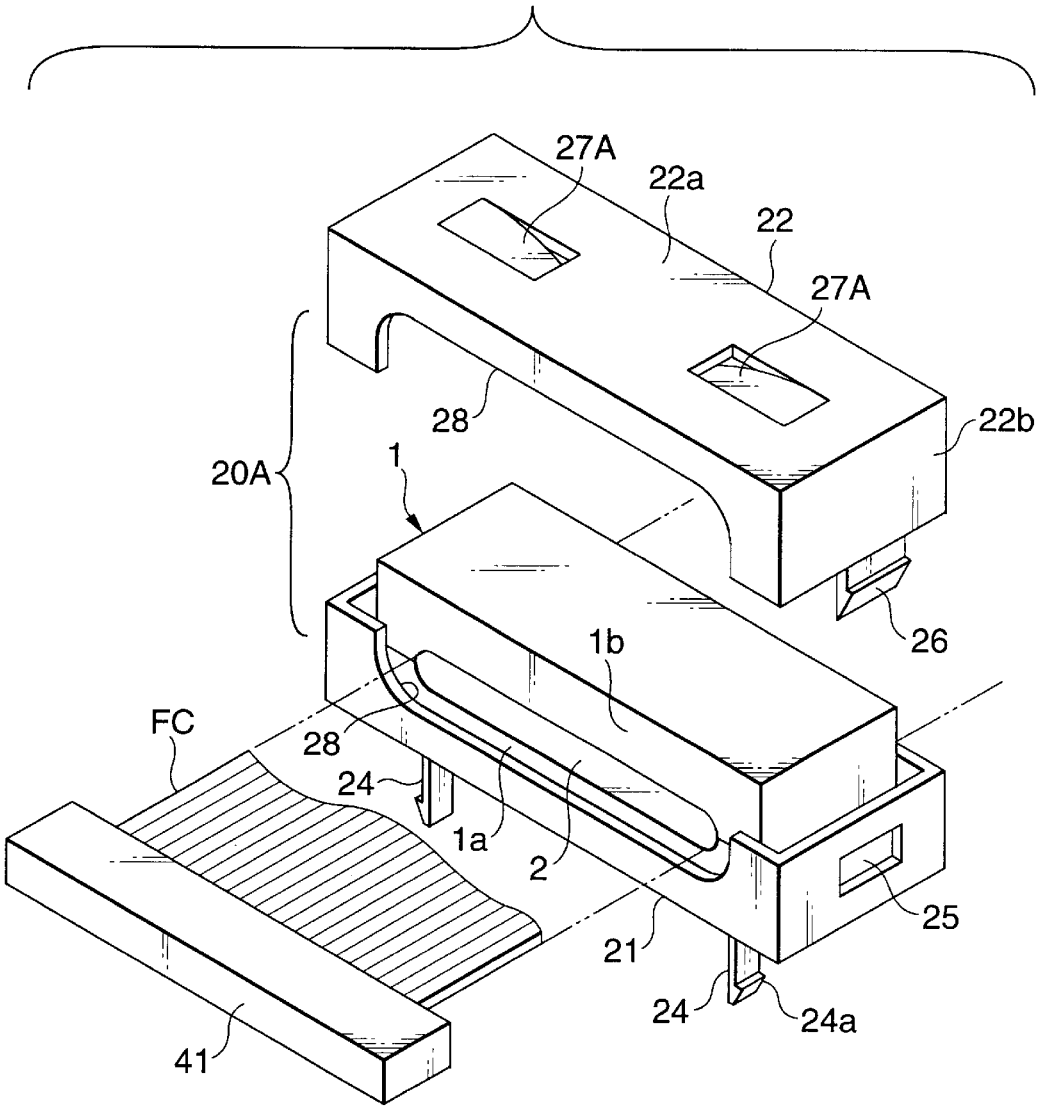
FIG. 3 is an exploded perspective view showing a second embodiment of the invention.
Figure 4:
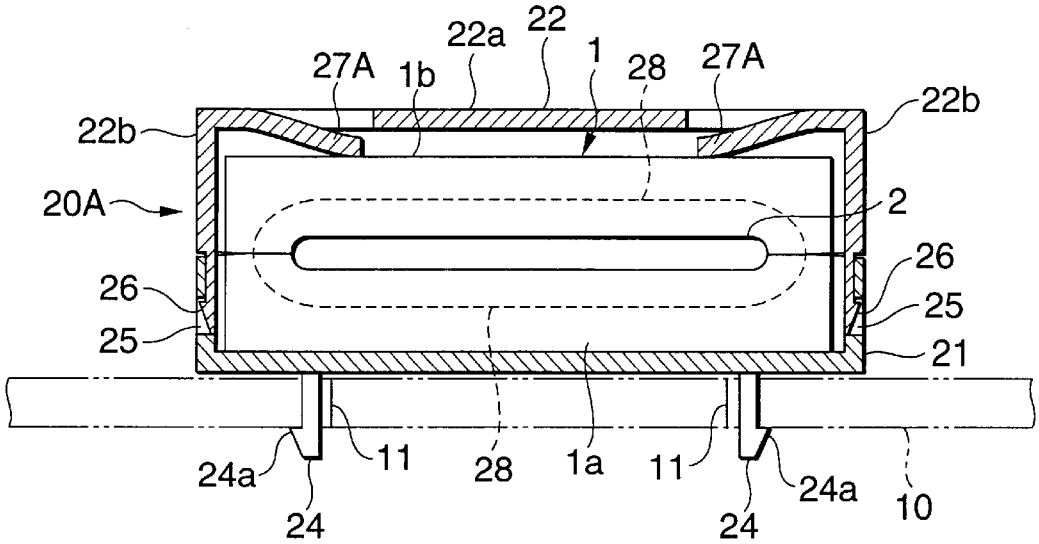
FIG. 4 is a front section view of the embodiment.

FIGS. 3 and 4 show a second embodiment of the invention. Referring to the figures, a ferrite-core housing case 20A is made of, for example, a metal or a resin (preferably, 66 Nylon) so as to cover a flat O-like (flat ring-like) ferrite core 1 having a slit-like hole 2 through which a flat cable FC is to be passed. The case consists of a first split case half (case body portion) 21, and a second split case half (case lid portion) 22 which is openable (detachable) with respect to the first split case half. Spring portions (elastic pressing portions) 27A each having a fulcrum located in the vicinity of the side face 22*b* of the case half are integrally formed in the upper face 22*a* of the second split case half 22, in order to press and fix the ferrite core 1 from the upper side by an elastic force. The other portions are configured in the same manner as those of the above-described first embodiment. Identical or equivalent portions are denoted by the same reference numerals, and their description is omitted.

In the second embodiment, the fulcrum of each of the spring portions 27A is located on the upper face 22*a* of the second split case half 22 and at a position in the vicinity of the side face 22*b*. In the embodiment, the position of the fulcrum is near the side face 22*b*, and hence it is possible to attain the same effects as those of the first embodiment. That is, deformation due to warpage of the ferrite-core housing case 20A can be prevented from occurring.

Figure 5:
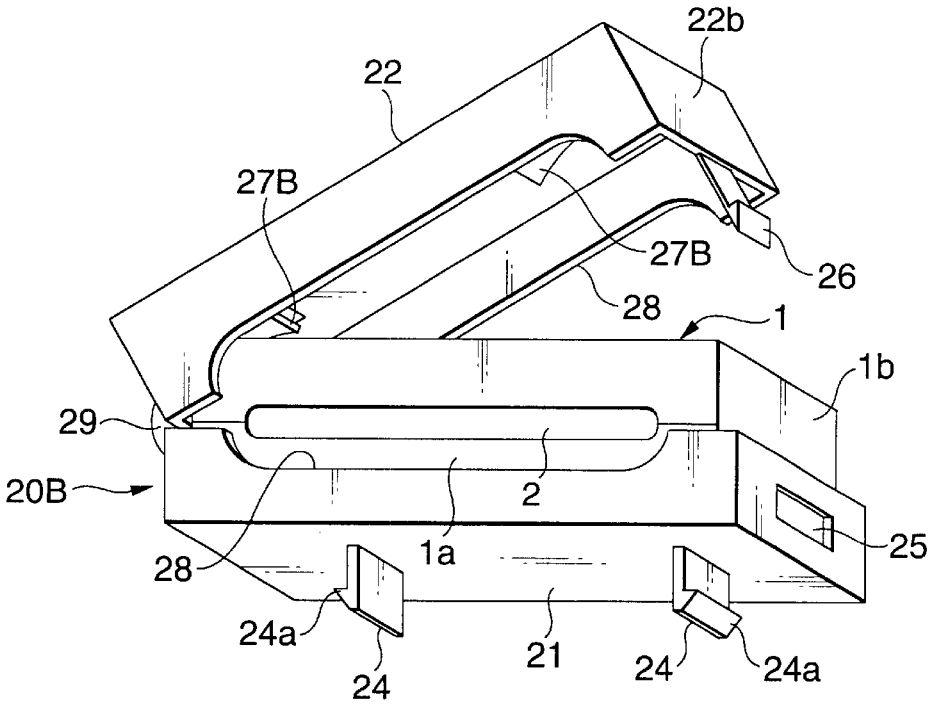
FIG. 5 is a perspective view of a third embodiment of the invention in a state where a case is opened.
Figure 6:
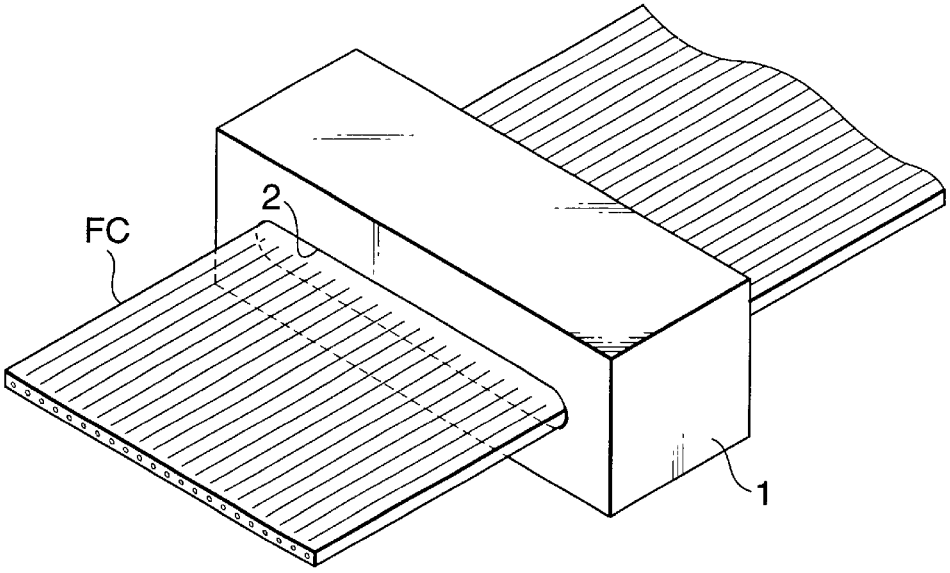
FIG. 6 is a perspective view showing the shape of a ferrite core used in an anti-noise measure for a flat cable.
Figure 7:
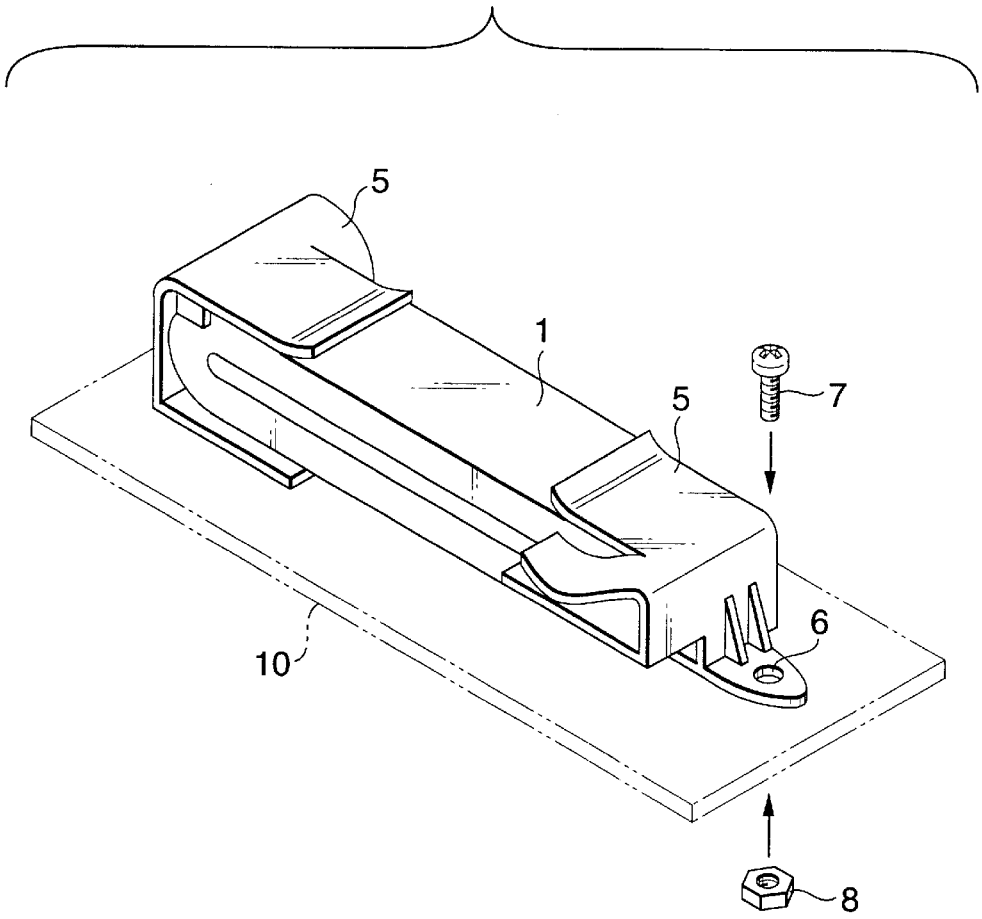
FIG. 7 is a perspective view showing a prior art example of a component which has been proposed and is commercially available and which is used for fixing a ferrite core for a flat cable.
Figure 8:
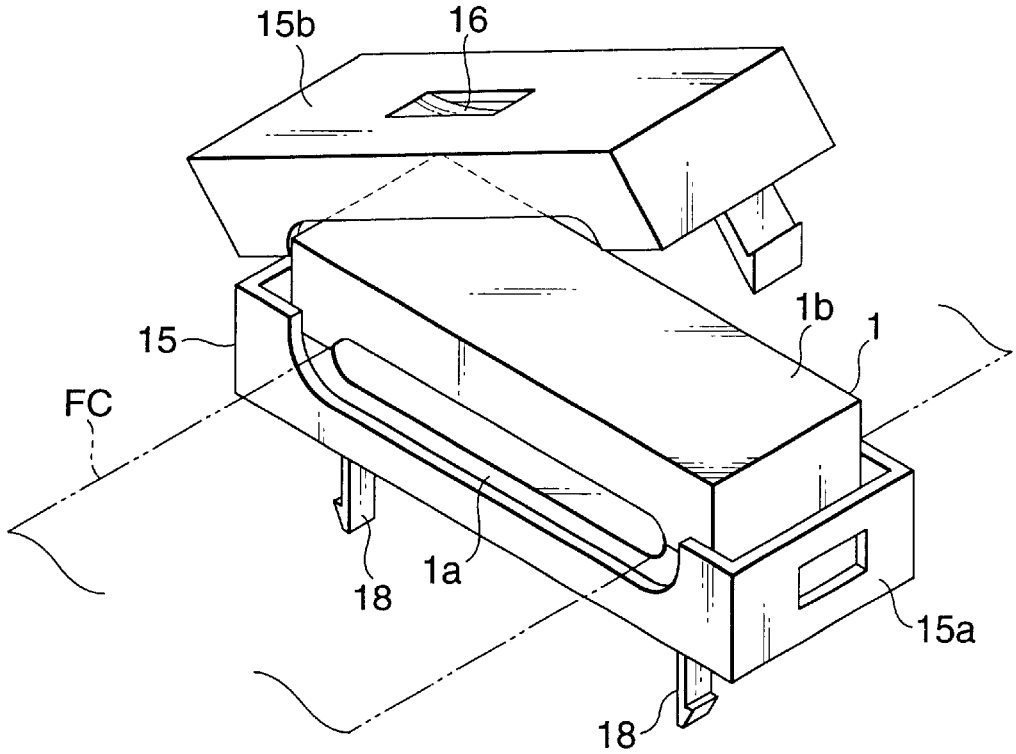
FIG. 8 is a perspective view showing an anti-noise component which has been proposed by the assignee of the present application.

FIG. 5 shows a third embodiment of the invention. Referring to the figure, a ferrite-core housing case 20B is made of, for example, a metal or a resin (preferably, 66 Nylon) so as to cover a flat O-like (flat ring-like) ferrite core 1 having a slit-like hole 2 through which a flat cable FC is to be passed. The case consists of a first split case half (case body portion) 21, and a second split case half (case lid portion) 22 which is openable (detachable) with respect to the first split case half. Spring portions (elastic pressing portions) 27B each having a fulcrum located on the side face 22*b* of the case half (or in the vicinity of the side face 22*b*) are integrally formed in the upper face 22*a* of the second case half 22, in order to press and fix the ferrite core 1 from the upper side by an elastic force. In the embodiment, the side faces the first and second split case halves 21 and 22 on one side are coupled to each other by a hinge portion 29. The side faces on the other side have a fitting structure which is similar to that of the above-described first embodiment.

The third embodiment is characterized in that the ferrite-core housing case 20B has the integral case structure in which the first and second split case halves 21 and 22 are coupled to each other by the hinge portion 29. The integral case structure facilitates the handling of the anti-noise component. Since the ferrite-core housing case is integrally formed as one part, the number of parts constituting the case is reduced from two to one. As a result, the handling of the case can be made easy, and labor for producing and managing the components can be largely simplified. As compared with a configuration wherein a case is completely split, also the workability of the assembling work can be improved.

The other configuration, functions, and effects are identical with those of the above-described first embodiment. Identical or equivalent portions are denoted by the same reference numerals, and their description is omitted.

Such a spring portion is required to be disposed in at least two place of the first or second split case half. When the ferrite core is to be pressed more strongly, it is preferable to dispose the spring portion more than two places. When spring portions are respectively disposed in both the two split case halves, the ferrite core can be pressed more strongly. Any material can be used as the material of the case. When an elastic material such as a resin is used, the case absorbs a shock to prevent the shock from acting on the ferrite core. Therefore, the use of such a material is particularly preferable.

The ferrite core may have either of the split type structure in which split ferrite core halves are combined with each other, or the integral type structure. In the case where the ferrite core is configured by combining split ferrite core halves with each other, even when cable connectors or the like have been already attached to the ends of the flat cable FC, the split core halves can be attached to the flat cable by covering the cable with the split core halves from the upper and lower sides. Therefore, the application range of the core can be widened. In this case, the disposition of the spring portion allows the split ferrite core halves to be maintained in a mutually closely contacted state.

In the embodiments described above, the coupling portion for maintaining the first and second split case halves to be in a closed state is configured by the pairs of the engaging holes 25 and the engaging pieces 26. Alternatively, the engaging pieces may be formed on the first split case half, and the engaging holes in the second split case half. Another engaging or fitting structure or the like in which the case halves are detachably or openably disposed may be employed.

As an example of means for attaching the ferrite-core housing case to the electronic apparatus housing or the circuit board 10, the fixation coupling portions 24 of FIG. 2 have been described. various kinds of means may be selected as the fixation coupling portions.

Figure 11:
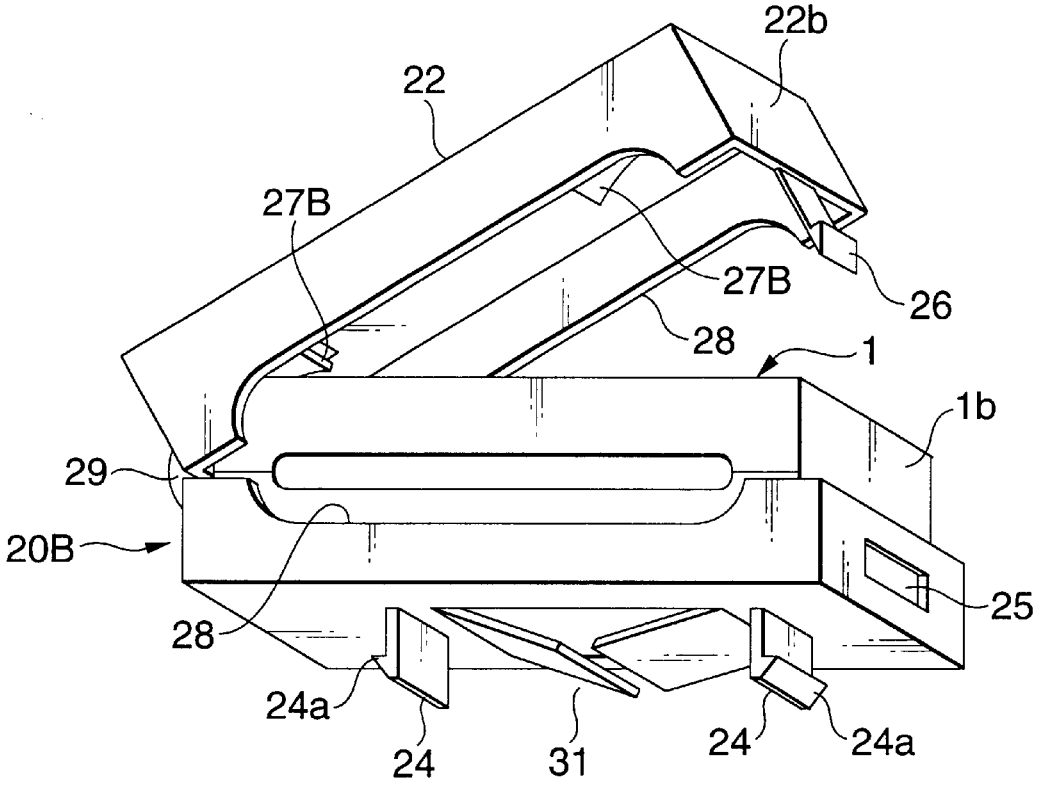
FIG. 11 is a perspective view of a modified embodiment of the invention.

Further, an elastic portion 31 which downward protrudes may be formed on a which protrude toward an apparatus to which the case is mounted as shown in FIG. 11. Accordingly, ratting of the ferrite-core against the apparatus to be mounted is prevented.

Figure 12:
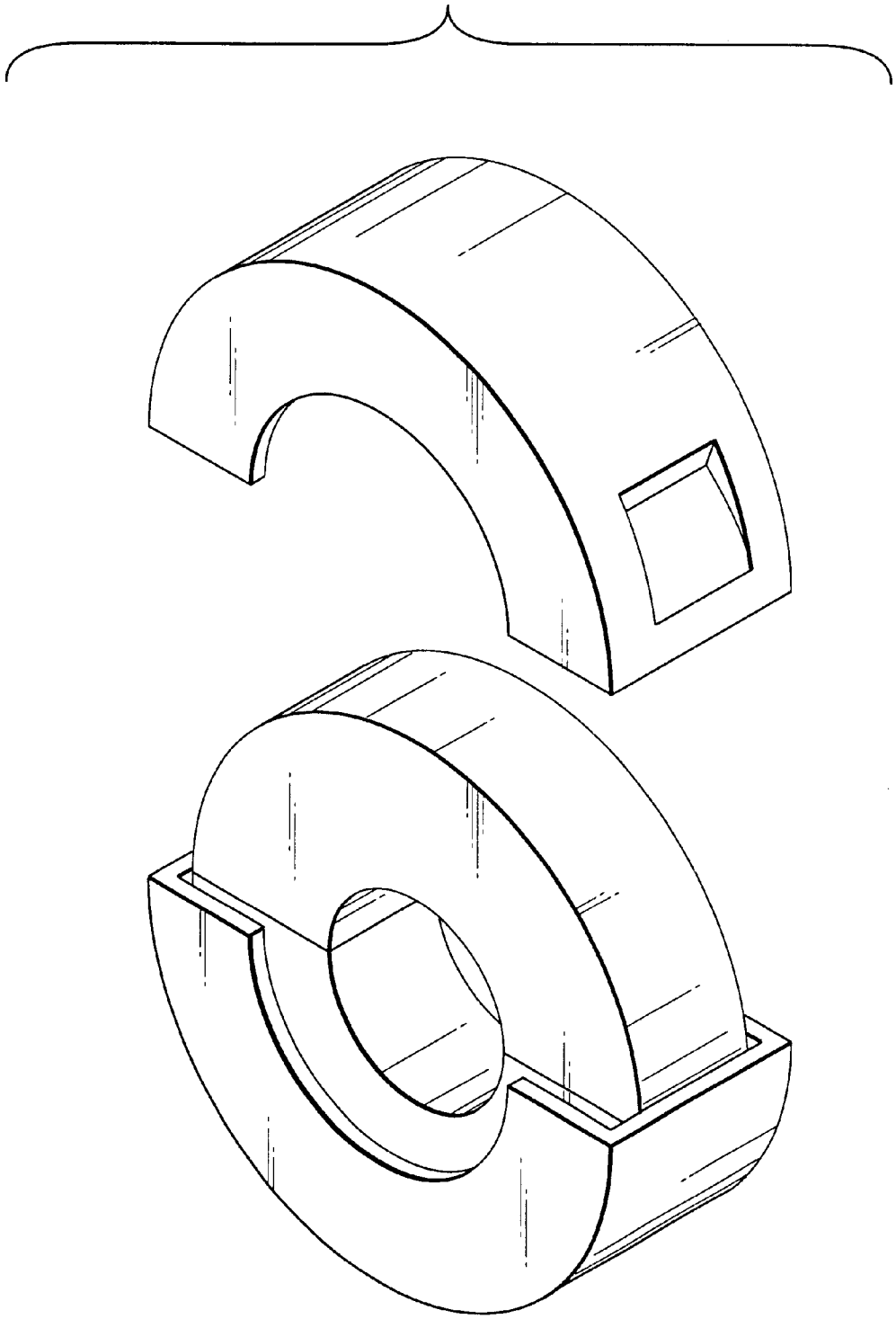
FIG. 12 is a perspective view of a circular ferrite core case of the invention.

Moreover, the present invention may be applied to the circular anti-noise component as shown in FIG. 12, although the above-mentioned embodiments have been described with respect to a noise-preventing component for use with a flat cable.

In the above, the embodiments of the invention have been described. It is obvious to those skilled in the art that the invention is not restricted to these embodiments and can be variously modified or changed within the scope of the claims.

As described above, according to the invention, it is possible to provide a ferrite-core housing case in which warpage and deformation of the case that houses a ferrite core are prevented from occurring, the ferrite core can be pressed so as to be surely held, and fixation and detachment of the ferrite core with respect to a flat cable can be easily implemented, and also an anti-noise component in which a ferrite core is housed in such a case, and also to realize a wire harness and an electronic apparatus which have an anti-noise component that can be easily attached to and detached from a flat cable and that can surely hold an incorporated ferrite core.

What is claimed is:

1. A ferrite-core housing case, comprising:

a first split case half;

a second split case half that is openable with respect to said first split case half;

said first and second split case halves forming a case adapted to house a ferrite core, through which an electronic cable passes;

a pair of spring portions each having a fulcrum and adapted to press against the ferrite core, and formed in at least one of said first and second split case halves, wherein said fulcrum of each of said spring portions is located on an end portion of a top surface of a split case half having said pair of spring portions formed thereon, and an acting point of each of said spring portions is located on a central portion of a split case half having said pair of spring portions formed thereon.

2. The housing case of claim 1, wherein the ferrite core is of a flat shape and has a flat slit through which the electronic cable comprising a flat cable passes.

3. The housing case of claim 1, wherein the ferrite core is of a ring shape and has a through-hole.

4. The housing case of claim 1, further comprising:

a pair of elastic portions formed one of said first end second case halves, and which protrude toward an apparatus to which the case is adapted to be mounted, wherein a fulcrum of each of said elastic portions is located on an end portion of a top surface of a split case half having said pair of elastic portions formed thereon, and an acting point of each of said elastic portions is located on a central portion of a split case half having said pair of elastic portions formed thereon.

5. An anti-noise component, comprising:

a ferrite core having a hole through which an electronic cable is to be passed; and an openable and closeable case which covers said ferrite core while said hole is exposed through said case;

said case comprising:

a first split case half;

a second split case half that is openable with respect to said first split case half;

a pair of spring portions, each having a fulcrum which press against said ferrite core and being formed in at least one of said first and second split case halves, wherein said fulcrum of each of said spring portions is located on an end portion of a top surface of a split case half having said pair of spring portions formed thereon, and an acting point of each of said spring portions is located on a central portion of a split case half having said pair of spring portions formed thereon.

6. The anti-noise component of claim 5, wherein said ferrite core is of a flat shape and has a flat slit through which the electronic cable comprising a flat cable passes.

7. The anti-noise component of claim 5, wherein said ferrite core is of a ring shape and has a through-hole.

8. The anti-noise component of claim 5, further comprising:

a pair of elastic portions formed one of said first end second case halves, and which protrude toward an apparatus to which the case is adapted to be mounted, wherein a fulcrum of each of said elastic portions is located on an end portion of a top surface of a split case half having said pair of elastic portions formed thereon, and an acting point of each of said elastic portions is located on a central portion of a split case half having said pair of elastic portions formed thereon.

9. A wire harness, comprising:

a ferrite core having a hole therethrough;

an electronic cable which passes through said hole; and an openable and closeable case which covers said ferrite core while said hole is exposed through said case, wherein said case, includes, a first split case half, and a second split case half that is openable with respect to said first split case half, a pair of spring portions, each having a fulcrum, which press against said ferrite core and are formed in at least one of said first and second split case halves, said fulcrum of each of said spring portions is located on an end portion of a top surface of a split case half having said pair of spring portions formed thereon, and an acting point of each of said spring portions is located on a central portion of a split case half having said pair of spring portions formed thereon.

10. An electronic apparatus including an anti-noise component comprising:

a ferrite core having a hole through which an electronic cable is passed; and an openable and closeable case which covers said ferrite core while said hole is exposed through said case, said case comprising:

a first split case half; and a second split case half that is openable with respect to said first split case half, a pair of spring portions, each having a fulcrum, which press said ferrite core and being formed in at least one of said first and second split case halves, wherein said fulcrum of each of said spring portions is located on an end portion of a top surface of a split case half having said pair of spring portions formed thereon, and an acting point of each of said spring portions is located on a central portion of a split case half having said pair of spring portions formed thereon.

* * * * *